US005509458A

United States Patent [19]

Onuma et al.

[11] Patent Number: 5,509,458

[45] Date of Patent: Apr. 23, 1996

[54] VACUUM CASTING APPARATUS AND METHOD USING THE SAME

[75] Inventors: Hiroshi Onuma, Mooka; Takashi Mimata, Fukuoka; Kimio Kubo, Tochigi, all of Japan

[73] Assignee: Hitachi Metals, Ltd., Japan

[21] Appl. No.: 331,547

[22] PCT Filed: Mar. 11, 1994

[86] PCT No.: PCT/JP94/00393

§ 371 Date: Jan. 19, 1995

§ 102(e) Date: Jan. 19, 1995

[87] PCT Pub. No.: WO94/20240

PCT Pub. Date: Sep. 15, 1994

[30] Foreign Application Priority Data

| | | | |
|---|---|---|---|
| Mar. 12, 1993 | [JP] | Japan | 5-052060 |
| Jun. 29, 1993 | [JP] | Japan | 5-158676 |
| Jun. 29, 1993 | [JP] | Japan | 5-158677 |
| Oct. 19, 1993 | [JP] | Japan | 5-260554 |

[51] Int. Cl.[6] ..... B22D 18/06

[52] U.S. Cl. ..... 164/63; 164/255

[58] Field of Search ..... 164/255, 254, 164/63, 119, 306

[56] References Cited

U.S. PATENT DOCUMENTS

| | | |
|---|---|---|
| 3,774,668 | 11/1973 | Iten et al. . |
| 3,863,706 | 2/1975 | Chandley et al. . |
| 5,069,271 | 12/1991 | Chandley et al. . |

FOREIGN PATENT DOCUMENTS

| | | | |
|---|---|---|---|
| 59-1060 | 1/1984 | Japan | 164/63 |
| 60-56439 | 4/1985 | Japan . | |
| 60-35227 | 8/1985 | Japan . | |
| 64-53759 | 3/1989 | Japan . | |
| 1-43753 | 6/1989 | Japan . | |
| 2-303649 | 12/1990 | Japan . | |
| 3-5061 | 1/1991 | Japan | 164/63 |
| 3-47666 | 2/1991 | Japan . | |
| 3-71969 | 3/1991 | Japan . | |
| 3-146255 | 6/1991 | Japan | 164/63 |

OTHER PUBLICATIONS

International Search Report.

*Primary Examiner*—Kuang Y. Lin

*Attorney, Agent, or Firm*—Finnegan, Henderson, Farabow, Garrett & Dunner

[57] ABSTRACT

A vacuum casting apparatus of the invention in which a melt is introduced into a mold cavity under vacuum, comprises (a) a vacuum vessel having at least one opening at its bottom; (b) a mold disposed within the vacuum vessel and having a mold cavity, a runner having an opening at a position under the opening of the vacuum vessel and extending along at least partially the side of the mold cavity, the mold cavity communicating with the runner through a plurality of filling passages, and a suction recess formed near a riser; and (c) a vacuum means communicating with the vacuum vessel. When the vacuum means evacuates the interior of the vacuum vessel, the mold cavity is rapidly evacuated to result in rapid filling of the cavity with a melt.

27 Claims, 8 Drawing Sheets

VACUUM CASTING APPARATUS AND METHOD USING THE SAME

TECHNICAL FIELD

The present invention relates to a vacuum casting apparatus and a vacuum casting method using the apparatus. More particularly, the present invention relates to an apparatus and a method for casting articles of poor castability such as complicated-shaped or thin stainless steel casting or heat-resistant cast steel, etc.

BACKGROUND ART

In the production of a thin cast article having a thin portion of 5 mm thick or less, the fluidity of a melt introduced into a mold cavity is rapidly decreased because a part of the melt is rapidly cooled and easily solidified upon coming into contact with the internal wall of the mold cavity. This results in defects such as insufficient filling of the mold cavity, etc. In the production of a cast article of complicated shape, air and gases generated from the mold material are likely to be introduced into the resulting cast articles as defects such as blow holes. Thus, a defectless cast article which is thin and has complicated shape is difficult to be produced.

As a method of producing a thin cast article having complicated shape, a lost wax process has been known. In this method, a ceramic mold is heated to 700°–900° C. prior to the filling of the cavity with a melt to retard the cooling of the melt introduced into the cavity, thereby keeping the melt highly flowable. However, since a ceramic mold is expensive, the production cost of a thin cast article having a complicated shape would be extremely high.

As an alternative method, JP-A-60-56439 discloses a gypsum mold provided with a cavity, runner, etc., in which a refractory filter having a gas permeability higher than that of the gypsum is disposed in an area ranging from the neighborhood of a last-filled portion of the cavity to the outside surface of the gypsum mold, thereby enhancing the evacuation capability to increase the fluidity of the melt and prevent the defect due to gas. The gypsum mold is produced by hydration-setting a gypsum slurry and drying the hardened gypsum. This method utilizing the gypsum mold, as is the case of the lost wax process mentioned above, has been known as one of the precision casting methods for producing a cast article of a high dimensional accuracy, and has been used for producing dies, parts for machines, artistic handicrafts, etc.

However, since the production of a gypsum mold includes the steps of kneading, pouring, hydralion setting, pattern draw, drying, etc. takes a long period of time, over 48 hours, the productivity of this method is poor. Further, since the gas permeability of the gypsum mold is extremely low, it leads to difficulties in determining the casting design for evacuation and pressurization at filling of a cavity with a melt. In addition, since the cooling rate of a gypsum mold is low, the melt in the mold solidifies extremely slowly. Therefore, in the case of casting a thin article of complicated shape, a shrinking defect is likely to occur, resulting in a low yield of the desired cast article.

Recently, a vacuum casting method as disclosed in JP-B-60-35227, etc. has come to be used. In this method, a melt is introduced into a mold cavity by evacuating a mold. However, in this method, air is likely to be incorporated into the melt through a mold portion which is not immersed in the melt, failing to obtain a sufficient vacuum. Further, although it is applicable to casting of articles of low height and simple shape, it is difficult to be applied to casting of high and thick articles of complicated shape.

JP-A-64-53759 discloses an apparatus in which a mold provided with a runner passing through the mold is disposed in a vacuum vessel, the upper end of the runner being closed with a stopper which does not pass a melt through it. A mold cavity, runner, etc. is filled with a melt by adjusting the pressure applied on the upper end of the runner passing through the mold lower than the pressure of the interior of the vacuum vessel surrounding the mold. However, in this art, since the vessel is evacuated through a hole positioned above the sprue, a sufficient vacuum can not be achieved at last-filling portions of the mold cavity, riser, run-off, etc.

JP-A-2-303649 discloses a vacuum casting method in which a mold having rammed particulate matter around it is maintained in a vacuum vessel by virtue of vacuum, and the mold is immersed into a melt thereby introducing a melt into the mold. In this method, however, since a mold is immersed in a melt together with the rammed particulate matter around it, the melt is disturbed before and after the immersion of the mold to cause an incorporation of air into the melt. Further, since a mold and rammed particulate matter around it project out from the vacuum vessel, air is likely to be incorporated into the melt from the bottom portion of the mold.

As mentioned above, the filling of a mold cavity with a melt is insufficient in the prior art method. In particular, the casting of a thin cast article, 5 mm thick or less, particularly 3 mm thick or less, having a complicated shape is difficult in the prior art method.

Accordingly, an object of the present invention is to provide a vacuum casting apparatus suitable for producing a cast article, particularly a thin cast article having a complicated shape, without suffering from casting defects such as insufficient filling, blow holes, etc. in a good productivity.

Another object of the present invention is to provide a vacuum casting method which shows the effect mentioned above.

DISCLOSURE OF INVENTION

As a result of intense research in view of the above object, the inventors have found that a remarkably high suction effect can be obtained by providing a suction recess near a mold cavity, a riser and a run-off of a mold disposed in a vacuum vessel, and found that a feeding effect can be remarkably enhanced by communicating a mold cavity and a runner via at least two filling passages, thereby enabling to produce a high-quality, thin cast article having a complicated shape in a low cost and a good productivity. The present invention has been accomplished based on these findings.

Thus, a vacuum casting apparatus according to a first embodiment of the present invention comprises:

(a) a vacuum vessel having at least one opening at the bottom thereof;

(b) a mold disposed in the vacuum vessel and having a runner and a mold cavity communicating with the runner, the runner having an opening at the opening of the vacuum vessel; and (c) a vacuum means communicating with the vacuum vessel; wherein a suction recess having an opening on the top surface of the mold is disposed in the vicinity of a portion of the mold cavity which is most distant from the opening of the runner and which is lastly filled with a melt of casting material, and wherein the suction recess is so disposed that a distance between the bottom of the suction recess and the portion of the mold cavity is smaller than a distance between the outer surface of the mold and any other portions of the mold cavity, thereby rapidly filling the mold cavity with the melt.

A vacuum casting method according to a first embodiment of the present invention comprises the steps of:

(a) disposing a mold having a runner and a mold cavity communicating with the runner in a vacuum vessel having at least one opening at the bottom thereof so that an opening of the runner is positioned in an area of the opening of the vacuum vessel;

(b) disposing a suction recess having an opening on the top surface of the mold in a vicinity of a portion of the mold cavity which is most distant from the opening of the runner and which is lastly filled with a melt of casting material so that a distance between the bottom of the suction recess and the portion of the mold cavity is smaller than a distance between the outer surface of the mold and any other portions of the mold cavity; and (c) evacuating the mold by operating a vacuum means connected to the vacuum vessel thereby rapidly filling the mold cavity with the melt.

A vacuum casting apparatus according to second embodiment of the present invention comprises:

(a) a vacuum vessel having at least one opening at the bottom thereof;

(b) a mold disposed within the vacuum vessel and having a mold cavity formed therein, a runner having an opening under the opening of the vacuum vessel and extending along at least partially the side of the mold cavity, the mold cavity communicating with the runner through a plurality of filling passages, and a suction recess having an opening on the top surface of the mold and disposed in a vicinity of a portion of the mold cavity which is most distant from the opening of the runner and which is lastly filled with a melt of casting material; and (c) a vacuum means communicating with the vacuum vessel; whereby the mold cavity is evacuated through the suction recess by operating the vacuum means more rapidly than mold portions other than the mold cavity to rapidly fill the mold cavity with the melt.

A vacuum casting method according to second embodiment of the present invention comprises the steps of:

(a) disposing in a vacuum vessel having at least one opening at the bottom thereof a mold having a mold cavity formed therein and a runner extending along at least partially the side of the mold cavity, the mold cavity communicating with the runner through a plurality of filling passages, so that an opening of the runner is positioned under the opening of the vacuum vessel;

(b) disposing a suction recess having an opening on the top surface of the mold in a vicinity of a portion of the mold cavity which is most distant from the opening of the runner and which is lastly filled with a melt of casting material so that a distance between the bottom of the suction recess and the portion of the mold cavity is smaller than a distance between the outer surface of the mold and any other portions of the mold cavity; and (c) evacuating the mold by operating a vacuum means connected to the vacuum vessel thereby rapidly filling the mold cavity with the melt.

BEST MODE FOR CARRYING OUT THE INVENTION

The present invention will be described in more detail.

[1] Cast Steel

The vacuum casting apparatus and vacuum casting method of the present invention is preferably used to cast a melt of steel, which has a high temperature and is difficult to be cast into a thin cast article. A cast steel produced by the vacuum casting apparatus and vacuum casting method has a high heat resistance and a high oxidation resistance. The composition of such a cast steel is, for example, as follows:

C: 0.05–0.45 weight %,

Si: 0.4–2 weight %,

Mn: 0.3–1 weight %,

Cr: 16–25 weight %,

W: 0–3 weight %,

Ni: 0–2 weight %,

Nb and/or V: 0.01–1 weight %, and

Fe and inevitable impurities: balance.

A cast steel having the above composition has, in addition to a usual α-phase, a so-called α'-phase (a-phase+carbides) transformed from λ-phase. The area ratio of α'-phase is preferred to be 20–90% based on the combined area of α-phase and α'-phase.

The vacuum casting apparatus and vacuum casting method of the present invention will be described in detail with reference to the drawings.

[2] First embodiment

Figure 1:
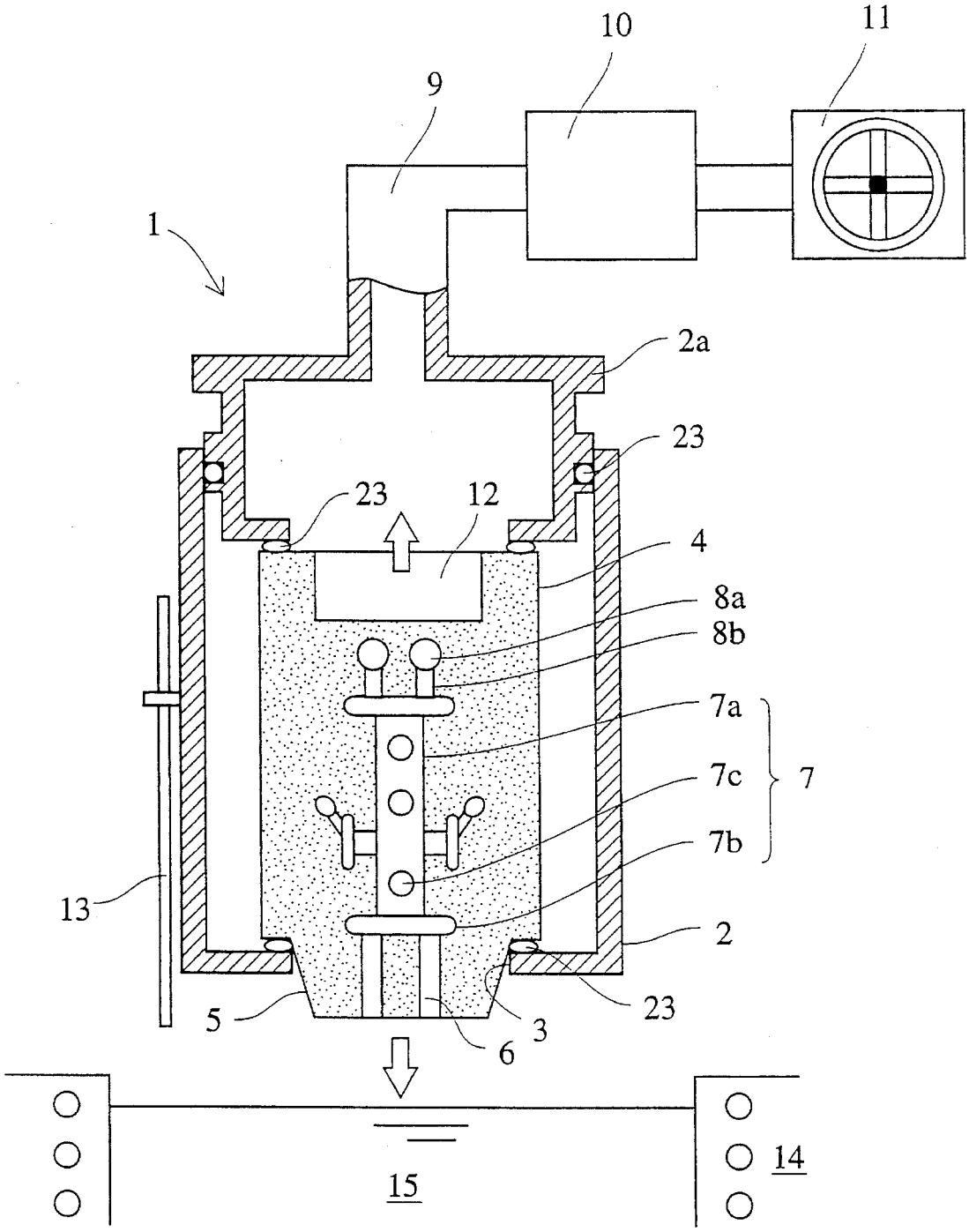
FIG. 1 is a schematic cross sectional view showing a vacuum casting apparatus according to the first embodiment of the present invention.

FIG. 1 is a schematic cross sectional view showing a vacuum casting apparatus according to a first embodiment of the present invention.

In FIG. 1, the vacuum casting apparatus 1 has a vacuum vessel having at least one opening at its bottom, and a mold having a mold cavity, runner, etc. and disposed in the vacuum vessel. The vacuum vessel is evacuated from the upper side thereof to suck a melt from a runner at a lower end of the mold thereby filling a mold cavity. Specifically, the vacuum casting apparatus 1 has a vacuum vessel 2 (a iron vacuum vessel having a 600 mm inner diameter and 800 mm height, for example) which has an opening 3 at the bottom thereof. The top of the vacuum vessel 2 is hermetically closed with a cover 2*a*. The cover 2*a* is provided with a flexible tube 9 which is connected to a vacuum means 11 such as a vacuum pump, etc. via a vacuum regulating means 10.

The vacuum vessel 2 has a sand mold 4 incorporated therein. In the present invention, a sand mold made of silica sand, etc. is preferable in view of the castability and gas permeability. For example, a split sand mold consisting of two vertical sections, which is molded by cold box process, is preferred. The sand mold 4 has at its lower end an entrance portion 5 projecting downward and is disposed in the vacuum vessel 2 so that the entrance portion 5 projects downward from the opening 3.

In the sand mold 4, a runner 6 having, for example, a cross-section of 10 mm long and 10 mm wide, extends vertically from the bottom of the entrance portion 5 to a mold cavity 7. The mold cavity may be of a shape comprising a pipe portion 7*a* having an outer diameter of 60 mm, a length of 200 mm and a thickness of 2.5 mm, a flange portion 7*b* having an outer diameter of 80 mm and a width of 3 mm, and a plurality of boss portions 7*c* projecting out from the pipe portion 7*a* and having an outer diameter of 10 mm and a height of 20 mm. It should be noted that the shape of the mold cavity 7 is not restricted to that described above. The inner surface of the mold cavity 7 is preferred to be coated with a mold coating in a thickness of 0.01–0.4 mm, preferably 0.15 mm. On the upper end of the mold cavity 7, a riser 8*a* (also serves as a run-off) and a gate 8*b* are provided. The vacuum vessel 2 and the cover 2*a*, the vacuum vessel 2 and the sand mold 4, and the cover 2*a* and the sand mold 4 are in contact with each other via packings 23 for maintaining the vacuum vessel 2 hermetically closed and preventing the vacuum degree of the mold cavity 7 from decreasing.

The upper surface of the sand mold 4 facing the vacuum side is concavely cut out toward the riser 8*a* to form a suction recess 12. The bottom of the suction recess 12 is preferred to be close to the riser 8*a* (also serve as a run-off) unless the mold portion between the bottom of the suction recess 12 and the riser 8*a* is broken due to a mechanical or thermal shock during the molding process. Specifically, the distance between the bottom of the suction recess 12 and the riser 8*a* is preferred to be about 15–30 mm. The diameter of the suction recess 12 is not specifically restricted unless the mechanical strength of the sand mold 4 is deteriorated, and may be determined based on the size of the mold cavity 7, the riser 8*a*, etc. For example, the suction recess 12 may have a diameter of about 300 mm.

On the outer side of the vacuum vessel 2, a sensor 13 for detecting that the vacuum casting apparatus 1 is immersed into a melt 15 in a melting furnace 14 is provided.

The casting by the vacuum casting apparatus 1 shown in FIG. 1 is operated by immersing the entrance portion 5 of the sand mold 4 into the melt 15 in the melting furnace 14. When the sensor 13 attached on the outer side of the vacuum vessel 2 detects the immersion of the entrance portion 5 into the melt 15, the downward moving of the vacuum vessel 2 is ceased while the evacuation by the vacuum means 11 is initiated. When the interior of the vacuum vessel 2 is evacuated, the air in the mold cavity 7 is also evacuated through the suction recess 12 which ensures that the mold cavity 7 is rapidly filled with the melt which flows into the runner 6. The vacuum degree of the mold cavity 7 can be regulated by changing the distance between the suction recess 12 and the riser 8*a*.

Figure 2:
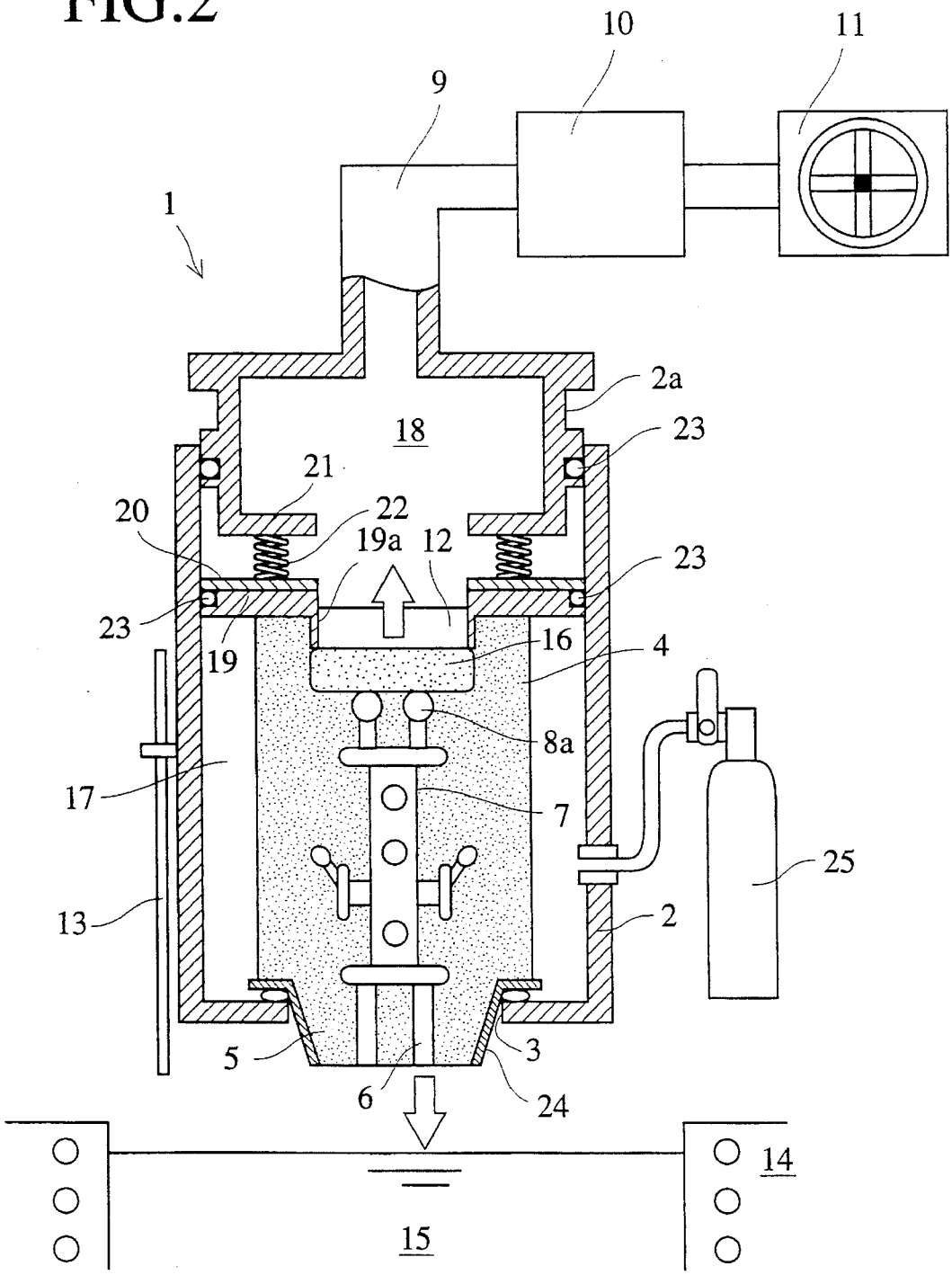
FIG. 2 is a schematic cross sectional view showing a modified embodiment of the vacuum casting apparatus shown in FIG. 1.

FIG. 2 is a schematic cross sectional view showing a modified embodiment of the vacuum casting apparatus shown in FIG. 1. The basic structure of the apparatus of FIG. 2 is the same as that of the apparatus of FIG. 1. Therefore, the same reference numerals are assigned to the members common to FIGS. 1 and 2.

In the vacuum casting apparatus shown in FIG. 2, a porous member 16 having a gas permeability larger than that of the mold 4 is disposed between the suction recess 12 and the riser 8*a* into which the melt 15 is finally introduced. The porous member 16 is preferred to be formed by ramming, for example, a molding sand coarser than the molding material of the mold 4 into a disc, plate, etc. The porous member 16 may be formed as an integral part of the mold 4 or as an individual part.

It is necessary that the gas permeability of the porous member 16 is larger than that of the mold 4, and preferably, the former is about 3–30 times the latter. For example, when a mold is formed of silica sand #6 (gas permeability: 261) and a mold coating (gas permeability: 48), the porous member 16 is preferred to be formed of silica sand #5 (gas permeability: 785) or silica sand #4 (gas permeability: 1130). The gas permeability mentioned above was measured according to JIS Z 2603-1976 (test method for gas permeability of molding sand).

The vacuum casting apparatus shown in FIG. 2 further has a partition member 19 composed of a impermeable material for separating the interior of the vacuum vessel 2 into a mold chamber 17 and vacuum chamber 18. By the partition member 19, the evacuating force is concentrated in the particular portion, in particular, the bottom of the suction recess 12 which is opposite the last-filled portion of the mold cavity. The partition member 19 has an opening communicating with the suction recess 12 and a projecting portion 19*a* extending downward to cover the side of the suction recess 12. A plate 20 having a central opening communicating with the suction recess 12 may be put on the top of the partition member 19.

A grasping means 22 such as coil spring, etc. is disposed between the plate 20 and a flange 21 of the cover 2*a* projecting into the interior of the vacuum chamber 18. The elastic force of the grasping means 22 is exerted on the mold 4 through the plate 20 and the partition member 19 thereby locating the mold 4 at a predetermined position in the mold chamber 17. A sealing member 23 such as packing, etc. is disposed between the plate 20 and the partition member 19 thereby airtightly isolating the vacuum chamber 18 and the mold chamber 17.

The vacuum casting apparatus shown in FIG. 2 is further equipped with a protecting frame 24 (made of steel, for example) which covers the side of the entrance portion 5 and the bottom surface of the mold 4. Since the lower part of the protecting frame 24 projects downward from the opening 3 of the vacuum vessel 2, the protecting frame 24 is also immersed into the melt 15 in the melting furnace 14 together with the entrance portion 5. The protecting frame 24 enhances the strength of the entrance portion 5, prevents the decrease in the vacuum degree of the runner 6, and further prevent the incorporation of air into the melt through the side of the entrance portion 5.

In the vacuum casting apparatus shown in FIG. 2, a supply means 25 is connected to the vacuum vessel 2. The supply means 25 supplies an inert gas under pressure into the vacuum vessel 2 and replace the air in the vacuum vessel 4 with the inert gas. The preferred inert gas includes nitrogen gas, argon gas, etc.

The vacuum casting apparatus shown in FIG. 2 can be operated basically in the same manner as in the vacuum casting apparatus shown in FIG. 1. First, the atmosphere of the vacuum vessel 2 is replaced with an inert gas. To this end, the air in the vacuum vessel 2 is purged away by supplying an inert gas from the supply means 25 to fill the vacuum vessel 2 with the inert gas. Then, the vacuum vessel 2 having the mold 4 therein is moved downward to immerse the entrance portion 5 into the melt 15 in the melting furnace 14, followed by sucking the melt into the runner 6.

Figure 3:
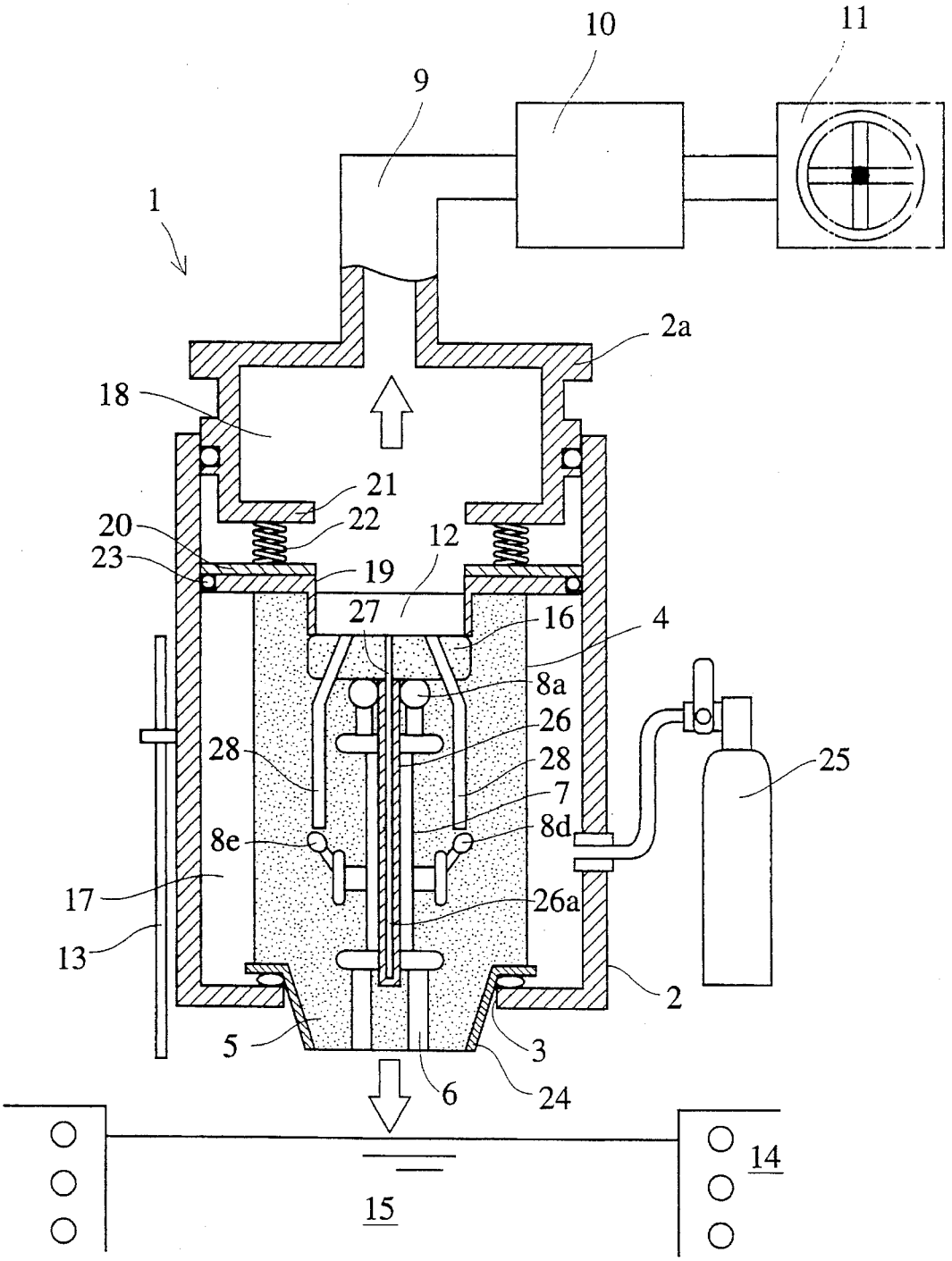
FIG. 3 is a schematic cross sectional view showing another modified embodiment of the vacuum casting apparatus shown in FIG. 1.

FIG. 3 is a schematic cross sectional view showing another modified embodiment of the vacuum casting apparatus shown in FIG. 1. The basic structure of the apparatus of FIG. 3 is the same as that of the apparatus of FIGS. 1 and 2. Therefore, the description on the members commonly shown in FIGS. 1–3 is omitted here.

In this embodiment, a hollow core 26 is disposed within the mold cavity 7. A hollow space 26*a* of the core 26 is communicated with the vacuum chamber 18 via a narrow suction duct 27 which communicates with the suction recess 12. With this structure, the suction force can be directly exerted to the interior of the core 26. The mold 4 has narrow suction ducts 28 which extend from the bottom of the suction recess 12 to the vicinity of last-filled portions 8*d* and 8*e* of the mold cavity 7. The ducts 28 aid in rapid and entire filling of the core 26 and the last-filled portions 8*d* and 8*e* with a melt. The vacuum casting apparatus shown in FIG. 3 can be operated in the same manner as in the vacuum casting apparatus shown in FIG. 2.

[3] Second embodiment

Figure 4:
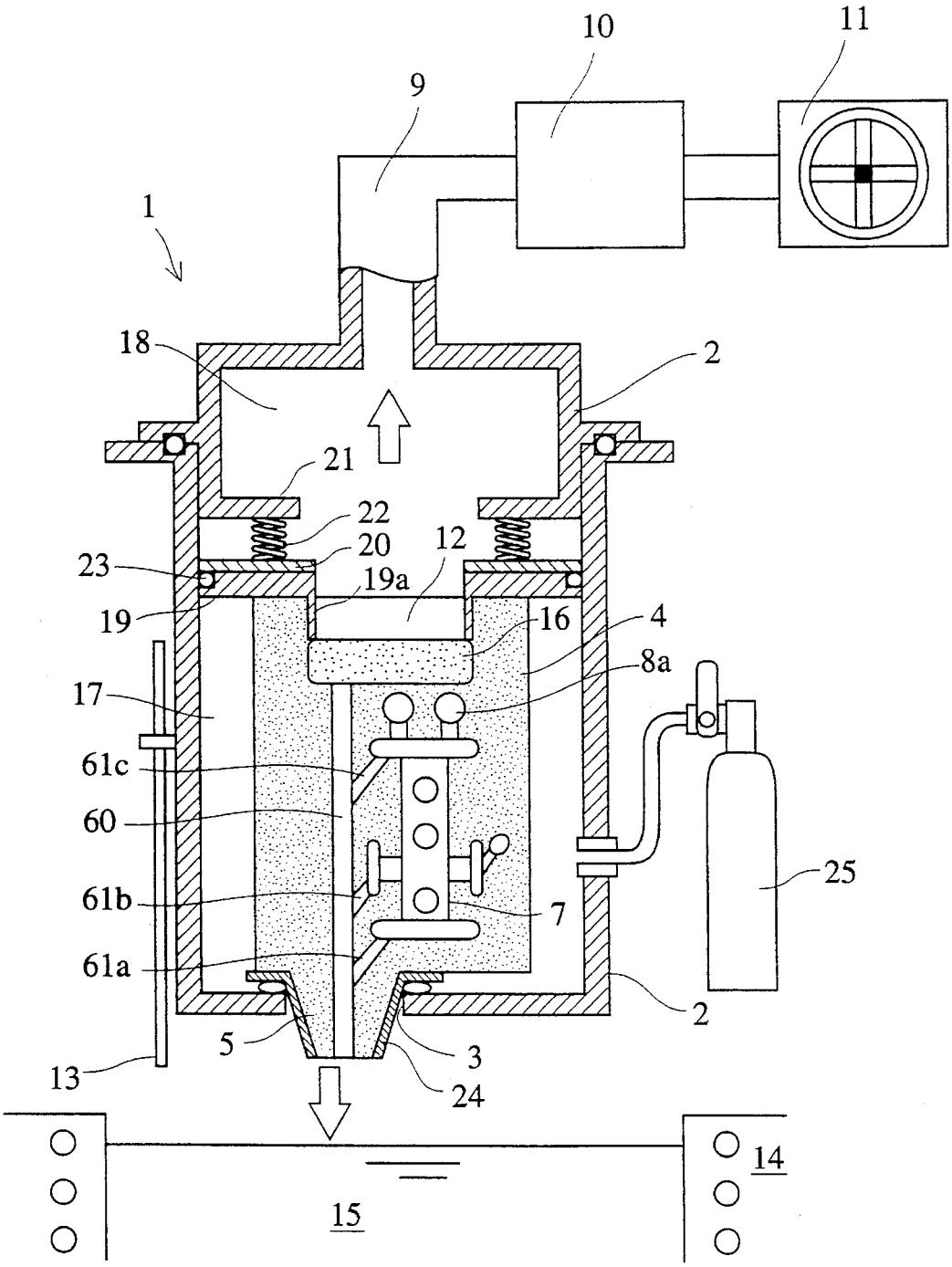
FIG. 4 is a schematic cross sectional view showing a vacuum casting apparatus according to the second embodiment of the present invention.

FIG. 4 is a schematic cross sectional view showing a vacuum casting apparatus according to a second embodiment of the present invention.

In this embodiment, the mold 4 has a runner 60 which extends, vertically for example, from the bottom of the entrance portion 5 to the vicinity of the suction recess 12 along at least partially the side of the mold cavity 7. The runner 60 communicates with the mold cavity 7 via three filling passages 61*a*, 61*b* and 61*c*. Each of the passages 61*a*, 61*b* and 61*c* ascends toward the mold cavity 7 so that the joining portion of the filling passage and the mold cavity 7 is positioned upward the joining portion of the filling passage and the runner 60. With this structure, the front of the melt flowing into the mold cavity 7 is scarcely disturbed, and the cavity 7 can be rapidly filled with the melt. Incidentally, another runner directly communicating with the bottom of the mold cavity 7 may be provided, if necessary.

The vacuum casting apparatus shown in FIG. 4 can be operated in the same manner as in the first embodiment except that the melt is rapidly introduced into the mold cavity 7 from the runner 60 extending along at least partially the side of the mold cavity 7 via the filling passages 61*a*, 61*b* and 61*c*. The vacuum degrees of the runner 60 and the mold cavity 7 are not necessarily the same. For example, at a certain stage during the evacuation, it is preferable to set the pressure in the runner 60 about 50 mmHg lower than that of the mold cavity 7.

Figure 5:
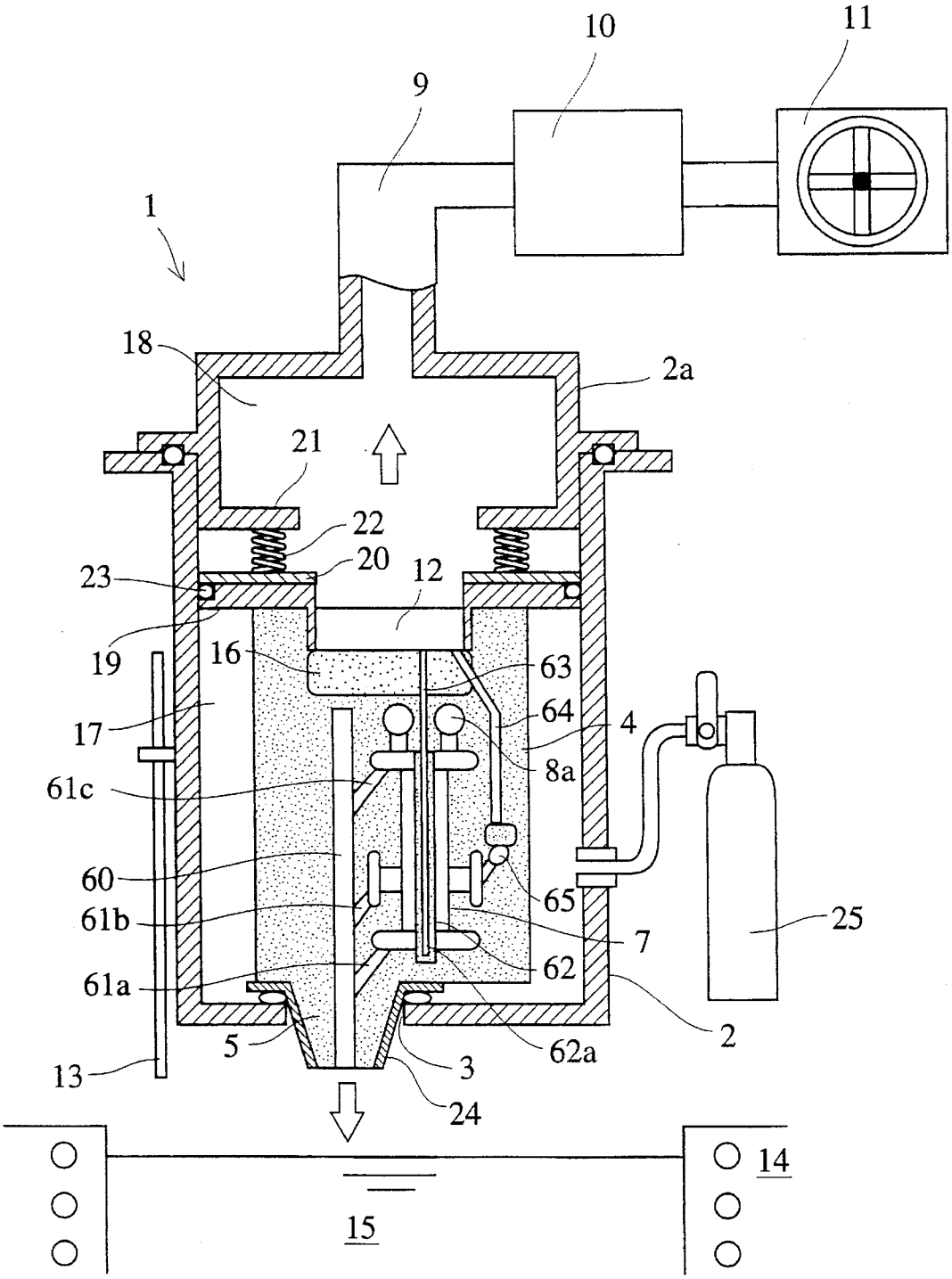
FIG. 5 is a schematic cross sectional view showing a modified embodiment of the vacuum casting apparatus shown in FIG. 4.

FIG. 5 is a schematic cross sectional view showing a modified embodiment of the vacuum casting apparatus shown in FIG. 4. The basic structure of the apparatus of FIG. 5 is the same as that of the apparatus of FIG. 4. Therefore, the description on the members commonly shown in FIG. 4 is omitted here.

In this embodiment, the mold 4 has a hollow core 62 incorporated into the mold cavity 7. A hollow space 62*a* of the core 62 is communicated with the vacuum chamber 18 via a narrow suction duct 63 which communicates with the suction recess 12. With this structure, the suction force can be directly exerted to the interior of the core 62. The mold 4 also has a narrow suction duct 64 which extends from the bottom of the suction recess 12 to the vicinity of a last-filled portion 65 of the mold cavity 7. The suction duct 64 aids in rapid and entire filling of the cavity 7 with a melt. The vacuum casting apparatus shown in FIG. 5 can be operated in the same manner as in the vacuum casting apparatus shown in FIG. 4.

Figure 6:
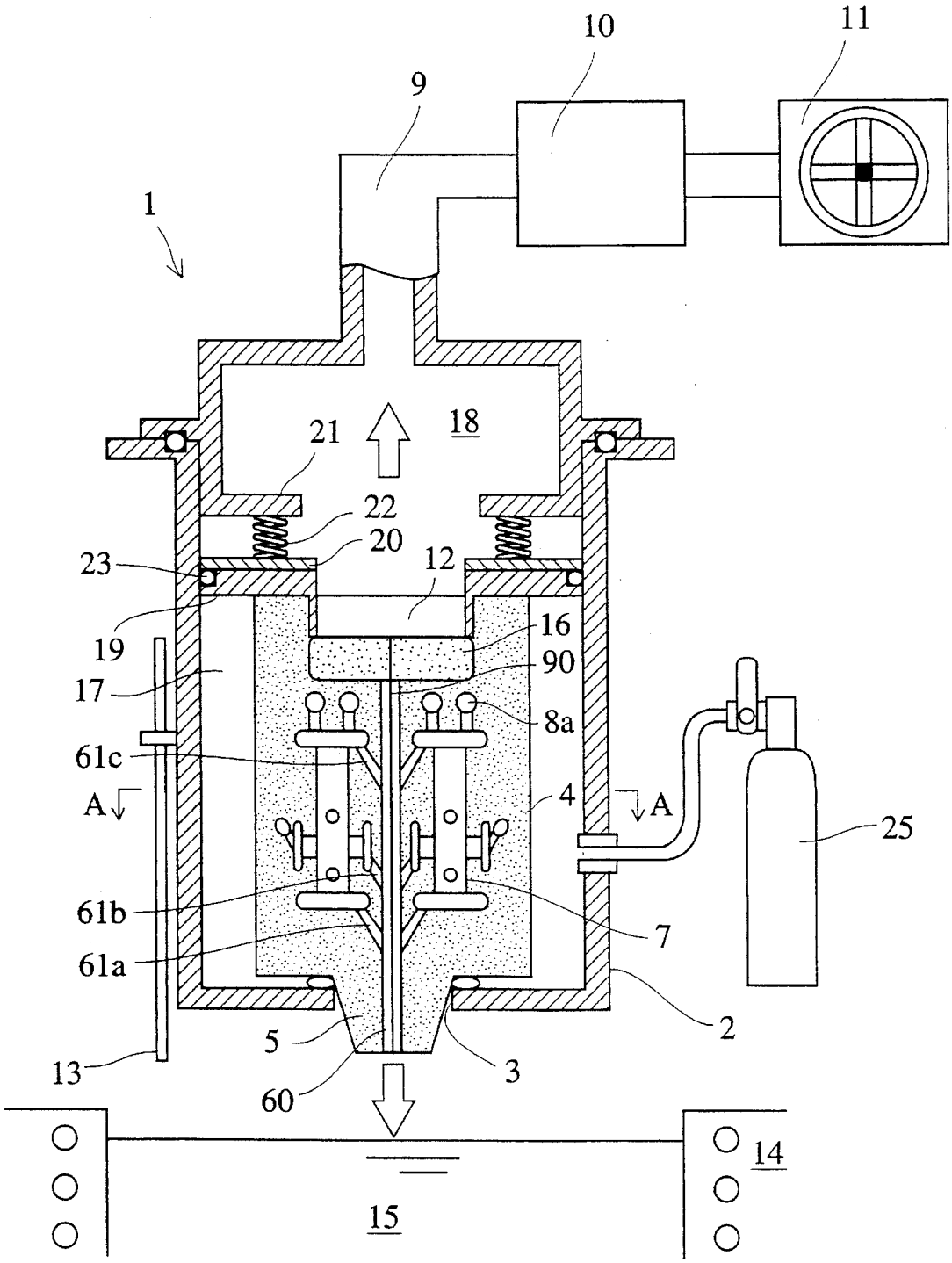
FIG. 6 is a schematic cross sectional view showing another modified embodiment of the vacuum casting apparatus shown in FIG. 4.
Figure 7:
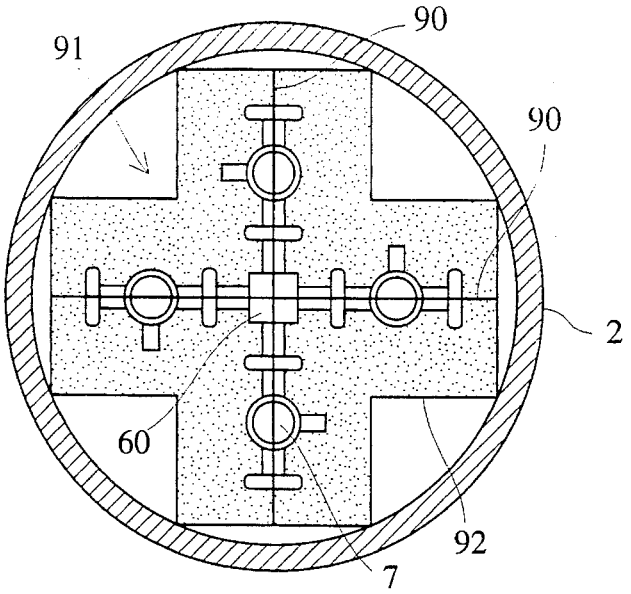
FIG. 7 is a cross sectional view taken along the line A—A of FIG. 6.

FIG. 6 is a schematic cross sectional view of a vacuum casting apparatus which has a fabricated mold (multi-cavity mold) consisting of a plurality of split molds and provided with a plurality of mold cavities so as to produce a plurality of cast articles in one casting operation. FIG. 7 is a cross sectional view of the apparatus of FIG. 6 taken along the A—A line. In FIGS. 6 and 7, although a four-cavity mold is shown, a fabricated mold to be used in the present invention is not limited to it.

Each mold cavity 7 and riser 8*a* may be of the same shape as those shown in FIG. 4. Each of the mold cavities 7 communicates via three filling passages 61*a*, 61*b* and 61*c* with a common runner 60 extending along the vertical center line. The parting plane 90 is so made that the parting plane coincides with the vertical plane which includes the vertical center line passing through the runner 60 and divides each mold cavity into tow partings. As seen from FIG. 7, the fabricated mold 91 is divided into four split molds 92 of the same shape by two parting planes 90 which perpendicularly intersect each other. In the same manner, an n-cavity mold may be fabricated from n split molds. By the use of the fabricated mold mentioned above, the cost for producing patterns, molds, etc. can be reduced. The vacuum casting apparatus in this embodiment may be operated in the same manner as in the vacuum casting apparatus shown in FIG. 4.

The present invention will be described in more detail with reference to the following examples. However, it is to be understood that the invention is not intended to be limited to the specific embodiments.

EXAMPLE 1

A melt (1550° C.) having a composition shown in Table 1 was cast by the vacuum casting apparatus shown in FIGS. 1 and 2 to produce cast steels of various thicknesses of at least 2.5 mm. Any casting defects such as insufficient filling, etc. were not observed in the thin cast articles.

TABLE 1

| (weight %) | | | | | |
|---|---|---|---|---|---|
| C | Si | Mn | Ni | Cr | Fe |
| 0.08 | 1.8 | 0.6 | 8.0 | 18.0 | Balance |

EXAMPLE 2

A melt (1580° C.) having a composition shown in Table 1 was cast by the vacuum casting apparatus shown in FIG. 4 to produce cast steels of various thicknesses of at least 2.0 mm. Any casting defects such as insufficient filling, flow back, etc. were not observed in the thin cast articles.

EXAMPLE 3

A melt (1610° C.) having a composition shown in Table 1 was cast by the vacuum casting apparatus shown in FIG. 5 to produce cast steels of various thicknesses of at least 1.5 mm. Any casting defects such as insufficient filling, flow back, etc. were not observed in the thin cast articles.

EXAMPLE 4

Figure 8:
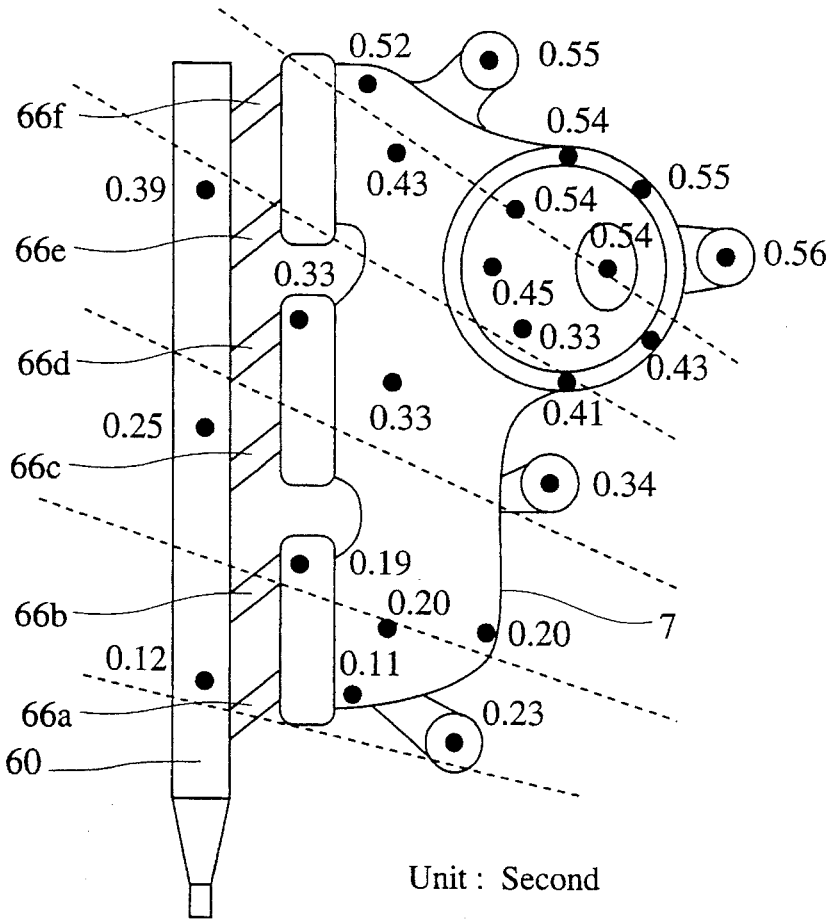
FIG. 8 is an illustration showing the filling condition of a cavity obtained by a measurement and a computer simulation.

In order to evaluate the flow of the melt in an apparatus having the structure shown in FIG. 4, the flow of the melt in a mold for producing a manifold shown in FIG. 8 was observed and simulated by computer. As shown in FIG. 8, the mold has a mold cavity 7 communicated with a runner 60 via six filling passages *66a–66f*. The results are shown in FIG. 8. The numerical values therein means the time (measured by second) required for the melt to reach the respective positions in the mold cavity.

As seen from FIG. 8, the melt drawn into the runner 60 was first introduced into the lower portion of the cavity 7 through the first filling passage *66a*. Just before the level of the melt thus introduced reached the upper end of the second filling passage *66b*, the melt passing through the second filling passage *66b* began to be introduced into the mold cavity 7. Thereafter, just before the new level of the melt in the mold cavity 7 reached the upper end of the next filling passage, the melt passing through the next filling passage began to be introduced into the mold cavity 7. This filling process was successively repeated until the mold cavity 7 was entirely filled with the melt. The rising condition of the melt level is shown in FIG. 8 by broken lines.

Thus, since a melt with a little temperature lowering is poured on to a melt already introduced into the mold cavity, the casting defects such as insufficient filling, leak defects, inclusion of air, blow holes, etc. can be effectively prevented.

Figure 9:
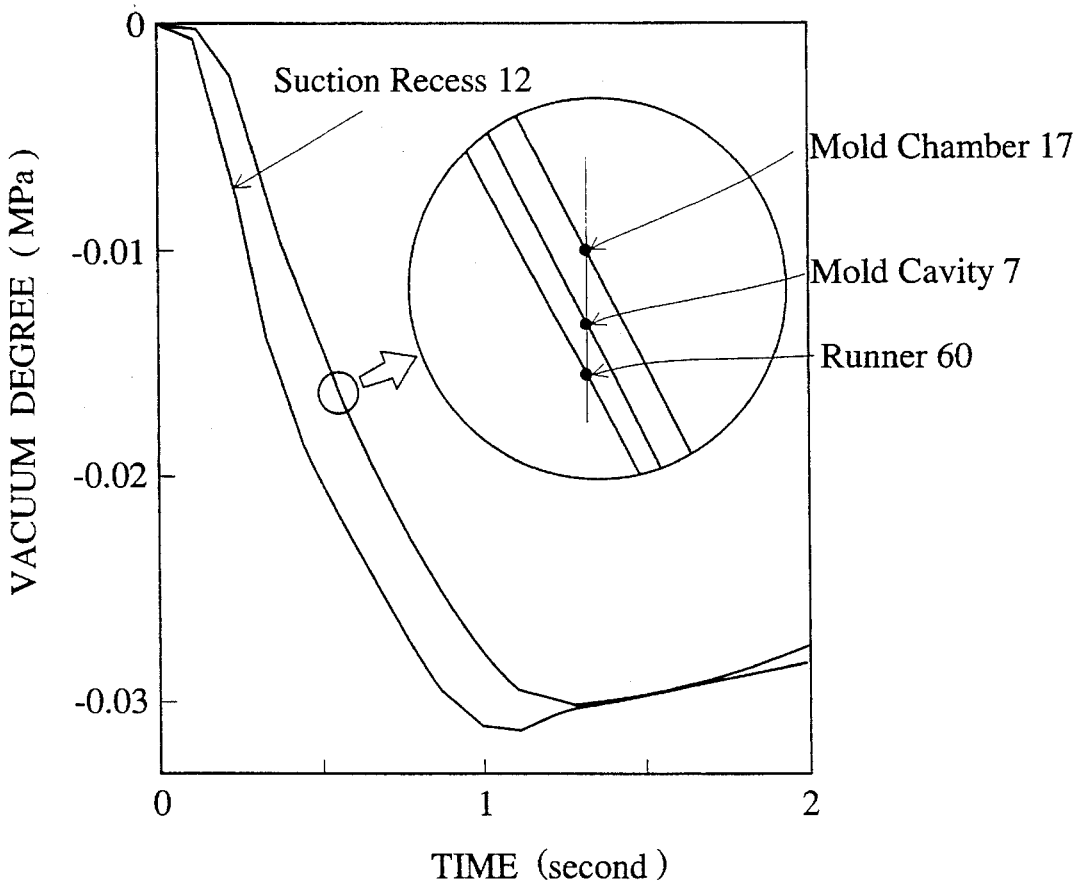
FIG. 9 is a graph showing vacuum degrees of some portions of the vacuum casting apparatus.

The vacuum degrees of some portions of the vacuum casting apparatus, which may be employed to fill the mold cavity with the melt in a manner shown in FIG. 8, are shown in FIG. 9. As seen from FIG. 9, the filling of the mold cavity 7 with the melt was completed within about one second. Further, it would be noted that in this period of time, the vacuum in the vacuum chamber 18 (suction recess 12) contributes to reducing the pressure in the runner 60 much more than to that of the mold cavity 7. Namely, the vacuum degree of the runner 60 is higher than that of the mold cavity 7. In order to impart such a high vacuum degree to the runner 60, the top end of the vertically extending runner 60 is preferred to reach near the suction recess 12.

INDUSTRIAL APPLICABILITY

As described above, in the present invention, a suction recess is provided at the vicinity of the mold cavity, riser or run-off included in a mold, in particular, at the vicinity of the cavity portion where a melt is finally introduced (last-filled portion). With this suction recess, the suction effect of the melt into the cavity is enhanced, and also the introduction of the melt into the last-filled portion can be facilitated. As a result, the casting defects such as insufficient filling, etc. can be prevented. In addition, by disposing a porous member having a gas permeability larger than that of a mold between a suction recess and a last-filled portion of a cavity, the vacuum degrees of the mold cavity, riser and run-off can be individually regulated, thereby enabling to control the flow speed of the melt.

Further, in the present invention, a runner is communicated with a mold cavity via a plurality of filling passages. With this structure, since a melt passing through one of the filling passages is introduced on to a melt already introduced in a mold cavity, the front temperature of the melt in the mold cavity can be prevented from lowering, thereby enabling to effectively avoiding insufficient filling, cold shut, shrinkage cavity, etc.

Since the vacuum casting apparatus and method of the present invention have technical advantages as described above, they are suitable for producing remarkably thin cast articles of steel, in particular for producing exhaust equipment members such as manifold, etc.

We claim:

1. A vacuum casting apparatus comprising:

(a) a vacuum vessel having at least one opening at the bottom thereof;

(b) a mold disposed in said vacuum vessel and having a runner and a mold cavity communicating with said runner, said runner having an opening under said opening of said vacuum vessel; and (c) a vacuum means communicating with said vacuum vessel; wherein a suction recess having an opening on the top surface of said mold is disposed in a vicinity of a portion of said mold cavity which is most distant from said opening of said runner and which is lastly filled with a melt of casting material, and wherein said suction recess is so disposed that a distance between the bottom of said suction recess and said portion of said mold cavity is smaller than a distance between the outer surface of said mold and any other portions of said mold cavity, thereby rapidly filling said mold cavity with said melt.

2. The vacuum casting apparatus according to claim 1, wherein a porous member having a gas permeability larger than that of said mold is disposed between said suction recess and said mold cavity.

3. The vacuum casting apparatus according to claim 1 or 2, wherein a vacuum chamber is formed in a portion of said vacuum vessel communicating with said vacuum means by covering with a partition member a mold surface facing said vacuum chamber except for a mold surface defining the bottom of said suction recess.

4. The vacuum casting apparatus according to claim 1, wherein said mold has a reverse-truncated cone projecting portion on the bottom surface thereof, said projecting portion projecting downward from said opening of said vacuum vessel, having on its bottom surface said opening of said runner, and the exposed surface of said projecting portion being covered with a protecting frame except for its bottom surface.

5. The vacuum casting apparatus according to claim 1, wherein a permeable, hollow core is disposed in said mold cavity, a hollow space of said hollow core being communicated with said suction recess via a narrow suction duct.

6. The vacuum casting apparatus according to claim 1, wherein said mold cavity is provided with a plurality of risers, and said mold is provided with at least one suction duct communicating with said suction recess and extending through said mold to a vicinity of one of said risers other than one positioned in a vicinity of said suction recess.

7. The vacuum casting apparatus according to claim 1, wherein said apparatus further comprising a supply means for supplying an inert gas into said vacuum vessel to replace the atmosphere of said vacuum vessel with said inert gas prior to evacuating said vacuum vessel.

8. A vacuum casting method comprising the steps of:

(a) disposing a mold having a runner and a mold cavity communicating with said runner in a vacuum vessel having at least one opening at the bottom thereof so that an opening of said runner is positioned under said opening of said vacuum vessel;

(b) disposing a suction recess having an opening on the top surface of said mold in a vicinity of a portion of said mold cavity which is most distant from said opening of said runner and which is lastly filled with a melt of casting material so that a distance between the bottom of said suction recess and said portion of said mold cavity is smaller than a distance between the outer surface of said mold and any other portions of said mold cavity; and (c) evacuating said mold by operating a vacuum means connected to said vacuum vessel thereby rapidly filling said mold cavity with said melt.

9. The vacuum casting method according to claim 8, wherein a porous member having a gas permeability larger than that of said mold is disposed between said suction recess and said mold cavity, thereby filling said mold cavity with said melt more rapidly.

10. The vacuum casting method according to claim 8 or 9, wherein a vacuum chamber is formed in a portion of said vacuum vessel communicating with said vacuum means by covering with a partition member a mold surface facing said vacuum chamber except for a mold surface defining the bottom of said suction recess, thereby enhancing a suction effect of said suction recess.

11. The vacuum casting method according to claim 8, wherein a permeable, hollow core is disposed in said mold cavity so that an open end of said hollow core is positioned in a vicinity of said suction recess, thereby rapidly evacuating said mold cavity through said hollow core.

12. The vacuum casting method according to claim 8, wherein said mold cavity is provided with a plurality of risers, and said mold is provided with at least one suction duct communicating with said suction recess and extending through said mold to a vicinity of one of said risers other than one positioned in a vicinity of said suction recess, thereby evacuating said mold cavity also through risers positioned in an area other than the vicinity of said suction recess.

13. The vacuum casting method according to claim 8, wherein said vacuum vessel is supplied with an inert gas to replace the atmosphere of said vacuum vessel with said inert gas prior to evacuating said vacuum vessel.

14. The vacuum casting method according to claim 8, wherein said vacuum vessel is evacuated after said opening of said runner is immersed into said melt maintained in a melting furnace.

15. A vacuum casting apparatus comprising:

(a) a vacuum vessel having at least one opening at the bottom thereof;

(b) a mold disposed within said vacuum vessel and having a mold cavity formed therein, a runner having an opening under said opening of said vacuum vessel and extending along at least partially the side of said mold cavity, said mold cavity communicating with said runner through a plurality of filling passages, and a suction recess having an opening on the top surface of said mold and disposed in a vicinity of a portion of said mold cavity which is most distant from said opening of said runner and which is lastly filled with a melt of casting material; and (c) a vacuum means communicating with said vacuum vessel; whereby said mold cavity is evacuated through said suction recess by operating said vacuum means more rapidly than mold portions other than said mold cavity to rapidly fill said mold cavity with said melt.

16. The vacuum casting apparatus according to claim 15, wherein said plurality of filling passages are formed along said runner and ascend toward said mold cavity, and the position and shape of each of said filling passages are defined so as to make a rising level of a melt introduced into said mold cavity approximately equal in height to a level of a melt to be introduced from a next filling passage.

17. The vacuum casting apparatus according to claim 15 or 16, wherein said runner extends to a vicinity of said suction recess to enable said melt to rapidly rise in said runner as well as to fill said mold cavity with said melt.

18. The vacuum casting apparatus according to claim 15, wherein a porous member having a gas permeability larger than that of said mold is disposed between said suction recess and said mold cavity.

19. The vacuum casting apparatus according to claim 15, wherein a vacuum chamber is formed in a portion of said vacuum vessel communicating with said vacuum means by covering with a partition member a mold surface facing said vacuum chamber except for a mold surface defining the bottom of said suction recess.

20. The vacuum casting apparatus according to claim 15, wherein said mold has a reverse-truncated cone projecting portion on the bottom surface thereof, said projecting portion projecting downward from said opening of said vacuum vessel, having on its bottom surface said opening of said runner, and the exposed surface of said projecting portion being covered with a protecting frame except for its bottom surface.

21. The vacuum casting apparatus according to claim 15, wherein a permeable, hollow core is disposed in said mold cavity, a hollow space of said hollow core being communicated with said suction recess via a narrow suction duct.

22. A vacuum casting method comprising the steps of:

(a) disposing in a vacuum vessel having at least one opening at the bottom thereof a mold having a mold cavity formed therein and a runner extending along at least partially the side of said mold cavity, said mold cavity communicating with said runner through a plurality of filling passages, so that an opening of said runner is positioned under said opening of said vacuum vessel;

(b) disposing a suction recess having an opening on the top surface of said mold in a vicinity of a portion of said mold cavity which is most distant from said opening of said runner and which is lastly filled with a melt of casting material so that a distance between the bottom of said suction recess and said portion of said mold cavity is smaller than a distance between the outer surface of said mold and any other portions of said mold cavity; and (c) evacuating said mold by operating a vacuum means connected to said vacuum vessel thereby rapidly filling said mold cavity with said melt.

23. The vacuum casting method according to claim 22, wherein a porous member having a gas permeability larger than that of said mold is disposed between said suction recess and said mold cavity, thereby filling said mold cavity with said melt more rapidly.

24. The vacuum casting method according to claim 22 or 23, wherein a vacuum chamber is formed in a portion of said vacuum vessel communicating with said vacuum means by covering with a partition member a mold surface facing said vacuum chamber except for a mold surface defining the bottom of said suction recess, thereby enhancing a suction effect of said suction recess.

25. The vacuum casting method according to claim 22, wherein a permeable, hollow core is disposed in said mold cavity so that an open end of said hollow core is positioned in a vicinity of said suction recess, thereby rapidly evacuating said mold cavity through said hollow core.

26. The vacuum casting method according to claim 22, wherein said mold cavity is provided with a plurality of risers, and said mold is provided with at least one suction duct communicating with said suction recess and extending through said mold to a vicinity of one of said risers other than one positioned in a vicinity of said suction recess, thereby evacuating said mold cavity also through risers positioned in an area other than the vicinity of said suction recess.

27. The vacuum casting method according to claim 22, wherein said vacuum vessel is evacuated after said opening of said runner is immersed into said melt maintained in a melting furnace.

* * * * *